US007069911B1

(12) United States Patent
Kubani et al.

(10) Patent No.: US 7,069,911 B1
(45) Date of Patent: Jul. 4, 2006

(54) APPARATUS AND METHODS FOR PROTECTING A CATALYTIC CONVERTER FROM MISFIRE

(75) Inventors: Ronald Joseph Kubani, Highland, MI (US); Vincent A. White, Northville, MI (US); Daniel P. Grenn, Highland, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 11/043,221

(22) Filed: Jan. 26, 2005

(51) Int. Cl.
*F02M 33/02* (2006.01)
*F02D 41/22* (2006.01)
*F02D 11/10* (2006.01)

(52) U.S. Cl. ..... 123/481; 123/520

(58) Field of Classification Search ..... 123/479, 123/481, 520
See application file for complete search history.

(56) References Cited

U.S. PATENT DOCUMENTS 6,422,226 B1 * 7/2002 Niki et al. ..... 123/690
6,516,772 B1 * 2/2003 Ueno et al. ..... 123/295
6,763,707 B1 * 7/2004 Kumagai et al. ..... 73/117.3

* cited by examiner

*Primary Examiner*—Hai Huynh
(74) *Attorney, Agent, or Firm*—Christopher DeVries

(57) ABSTRACT

A method of controlling engine operation in a vehicle in response to a misfire of one of a plurality of engine cylinders fueled through fuel injectors. The vehicle includes a fuel vapor storage canister. The method includes disabling at least one of the fuel injectors, using an open loop to control fuel delivery by the injectors to the cylinders, and disabling purging of the canister. The disabling and using steps are performed while the misfire continues.

22 Claims, 3 Drawing Sheets

APPARATUS AND METHODS FOR PROTECTING A CATALYTIC CONVERTER FROM MISFIRE

FIELD OF THE INVENTION

The present invention relates generally to engine control systems in vehicles and, more particularly, to an engine control system and method to protect a catalytic converter in the event of cylinder misfire.

BACKGROUND OF THE INVENTION

Automotive emissions are reduced substantially through the use of engine exhaust catalytic converters in vehicles. A catalytic converter can be damaged, however, if misfire occurs in one or more cylinders of the engine. A misfire could be caused by a number of events, for example, by a broken or disconnected wire in the vehicle ignition or injection systems. When a misfire occurs, unburned fuel may enter the catalytic converter from the misfiring cylinder and may cause reaction temperatures within the converter to increase sharply. Such increases can lead to overheating and damage of the catalytic converter.

In recently manufactured vehicles, misfire typically can be detected and diagnosed. A warning light may be activated if misfire occurs above a threshold level. It would be desirable to make use of misfire detection and diagnostics to protect the catalytic converter.

SUMMARY OF THE INVENTION

The present invention, in one implementation, is directed to a method of controlling engine operation in a vehicle in response to a misfire of one of a plurality of engine cylinders fueled through a plurality of fuel injectors. The vehicle further includes a storage canister in which fuel vapor can be collected and from which the fuel vapor can be purged for delivery to the cylinders. The method includes disabling at least one of the fuel injectors, using an open loop to control fuel delivery by the injectors to the cylinders, and disabling purging of the canister. The disabling and using steps are performed while the misfire continues.

In another configuration, the present invention is directed to a system for controlling engine operation in a vehicle in response to a misfire of one of a plurality of engine cylinders fueled through a plurality of fuel injectors. The vehicle further includes a storage canister in which fuel vapor can be collected and from which the fuel vapor can be purged for delivery to the cylinders. The system includes a misfire sensing module that senses the misfire. A control module provides a misfire diagnostic based on input from the misfire sensing module. Based on the diagnostic, the control module disables at least one of the fuel injectors, uses an open loop to control fuel delivery by the injectors to the cylinders, and disables purging of the canister.

In yet another implementation, the invention is directed to a method of controlling engine operation in a vehicle including a plurality of engine cylinders fueled through a plurality of fuel injectors. The vehicle further includes a storage canister in which fuel vapor can be collected and which can be purged for delivery of the fuel vapor to the cylinders. The method includes detecting a misfire of at least one one of the cylinders and analyzing at least one of the detected misfire and another misfire. Based on the analyzing, at least one of the fuel injectors is disabled, an open loop is used to control fuel delivery by the injectors to the cylinders, and purging of the canister is disabled.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF EXEMPLARY EMBODIMENTS

Figure 1:
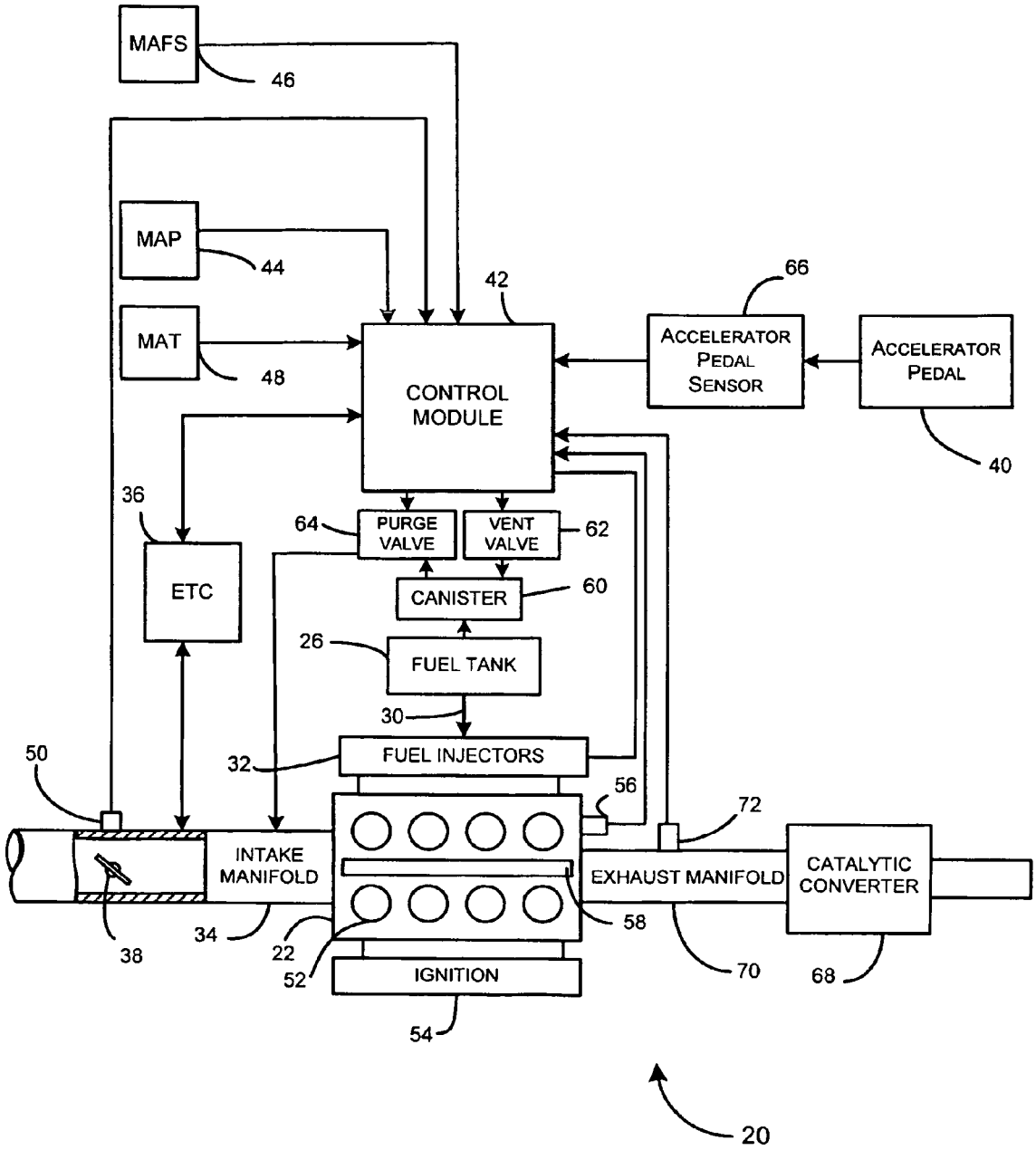
FIG. 1 is a functional block diagram of a system for controlling engine operation in a vehicle in accordance with one embodiment of the present invention.

The following description of various embodiments of the present invention is merely exemplary in nature and is in no way intended to limit the invention, its application, or uses. For purposes of clarity, the same reference numbers will be used in the drawings to identify similar elements. As used herein, the term module and/or device refers to an application specific integrated circuit (ASIC), an electronic circuit, a processor (shared, dedicated, or group) and memory that execute one or more software or firmware programs, a combinational logic circuit, or other suitable components that provide the described functionality.

Referring now to FIG. 1, a vehicle including a system for controlling engine operation in accordance with one embodiment of the present invention is indicated generally by reference number 20. The vehicle 20 includes an engine 22 and a fuel tank 26. Fuel is delivered to the engine 22 from the tank 26 through a fuel line 30 and through a plurality of fuel injectors 32. Air is delivered to the engine 22 through an intake manifold 34. An electronic throttle controller (ETC) 36 adjusts a throttle plate 38 that is located adjacent to an inlet of the intake manifold 34 based upon a position of an accelerator pedal 40 and a throttle control algorithm that is executed by a control module 42. The control module 42, in controlling operation of the vehicle 20, uses an intake manifold absolute pressure (MAP) sensor signal 44, a mass air flow sensor (MAFS) signal 46, an intake manifold air temperature (MAT) sensor signal 48 and input from a throttle position sensor 50 that senses a position of the throttle plate 38.

The engine 22 includes a plurality of cylinders 52 that receive fuel from the fuel injectors 32. When an ignition system 54 ignites fuel in one of the cylinders 52, the cylinder "fires" to drive a piston (not shown). The cylinders 52 may be paired to fire simultaneously as known in the art. A misfire sensing module 56 senses misfire in one or more cylinders 52. The control module 42 uses input from the misfire sensing module 56 to provide a misfire diagnostic. The misfire sensing module 56 may include but is not limited to a crankshaft sensor that senses a position of a crankshaft 58 and provides a position signal to the control module 42. Additionally or alternatively, the misfire sensing module 56 may include ionization detection means and/or other means for detecting misfire in the cylinder(s) 52.

The control module 42 uses input from the misfire sensing module to detect whether, to what magnitude, and/or in which cylinder(s) 52 a misfire is sensed. For example, variation in speed of the crankshaft 58 may be measured by the control module 42 with reference to combustion in a cylinder 52. Abnormal variation in such measurements may be used to indicate cylinder misfire, which can be associated by the control module 42 with one or more specific cylinders 52. When misfire is detected above a predetermined threshold, the control module 42 activates a malfunction indicator light (MIL) and/or alarm in a passenger compartment of the vehicle 20.

Vapor from the fuel tank 26 is collected in a charcoal storage canister 60. The canister 60 may be vented to air through a vent valve 62. The canister 60 may be purged through a purge valve 64. When vapor is purged from the canister 60, it is delivered to the intake manifold 34 and burned in the engine cylinders 52. The control module 42 controls operation of the vent valve 62, purge valve 64, fuel injectors 32 and ignition system 54. The control module 42 also is connected with an accelerator pedal sensor 66 that senses a position of the accelerator pedal 40 and sends a signal representative of the pedal position to the control module 42.

A catalytic converter 68 receives exhaust from the engine 22 through an exhaust manifold 70. Output of one or more exhaust sensors 72 are used by the control module 42 in a closed-loop manner to regulate fuel delivery to the engine 22 through the injectors 32.

Figure 2A:
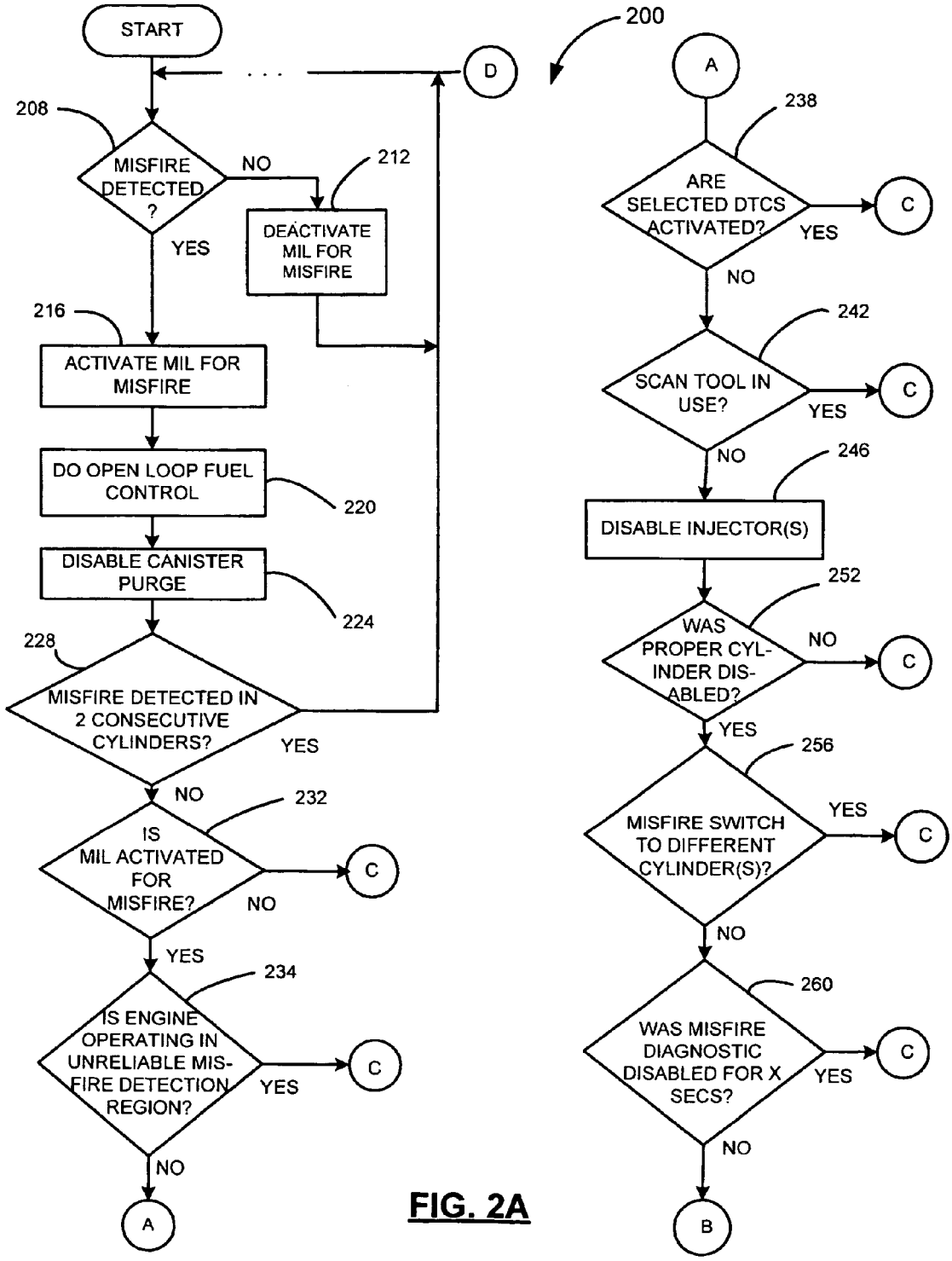
FIGS. 2A and 2B are a flow diagram of a method of controlling engine operation in a vehicle in accordance with one embodiment.
Figure 2B:
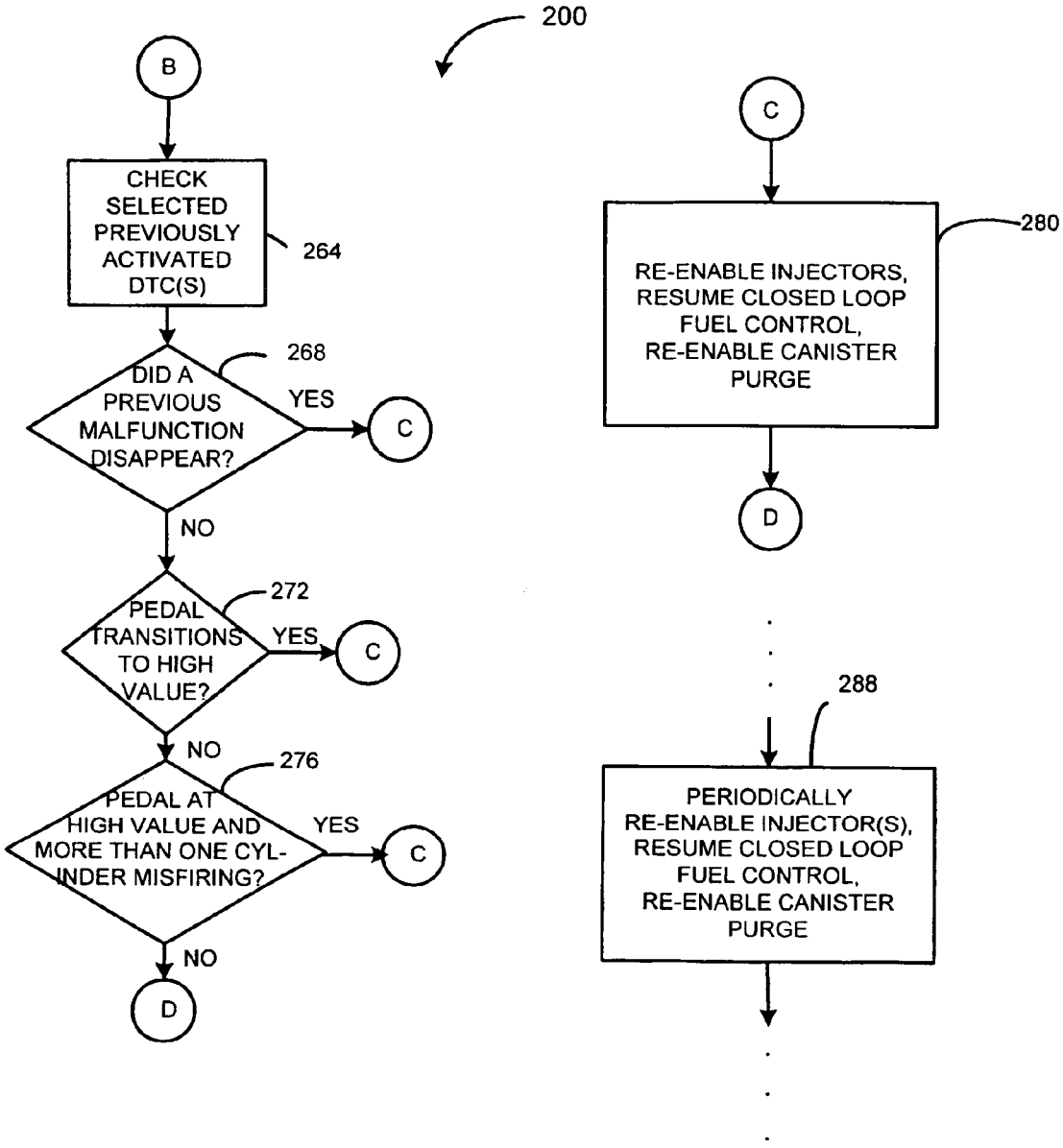

One implementation of a method of controlling operation of the engine 22 in response to misfire is indicated generally by reference number 200 in FIGS. 2A and 2B. In step 208 the control module 42 determines whether a misfire is sensed by the misfire sensing module 56. If a misfire is not detected, then in step 212 the control module 42 deactivates the misfire malfunction indicator light (MIL) and control returns to step 208.

If a misfire is detected in step 208, then in step 216 the misfire MIL is activated. Control passes from step 216 to step 220, in which the control module 42 initiates open-loop fuel control. Specifically and for example, the control module 42 controls intake air and fuel delivery in accordance with estimates of air intake and fuel delivery predetermined to achieve a desired operating state of the engine 22. In step 224 the control module 42 disables the canister purge valve 64 to prevent delivery of fuel vapor to the intake manifold 34.

In step 228 it is determined whether a misfiring of two consecutive cylinders 52 is detected. It typically is rare for two consecutive cylinders 52 to misfire. Also rare are occasions on which the misfire sensing module 56 may sense a single cylinder misfire as misfires of two consecutive cylinders 52. Accordingly, if it is determined in step 228 that two consecutive cylinders 52 were sensed as having misfired, control returns to step 208. If two consecutive cylinders were not sensed, then control passes to step 232. In step 232, it is determined whether the MIL is activated for misfire. If the MIL is not activated, control is transferred to step 280; if the MIL is activated, control passes to step 234.

In step 234 the control module 42 checks the speed and load of the engine 22 to determine whether the engine 22 is operating in an operating region associated with reduced accuracy for misfire detection and/or identification of a misfiring cylinder. If the engine 22 is operating in such a region, control passes to step 280. If the engine is not operating in such a region, control transfers to step 238.

In step 238 the control module 42 verifies whether one or more pre-designated diagnostic trouble codes (DTCs) are active. One such DTC may indicate whether a fault has been detected in the pedal sensor 66. Other DTCs could also be checked, including but not limited to a DTC indicating a fault status of the throttle position sensor 50. If in step 238 it is determined that such a DTC is active, then control transfers to step 280; otherwise control passes to step 242. In one implementation, one or more of the foregoing pre-designated DTCs, when activated, may cause the control module 42 to deactivate processing of input from the misfire sensing module 56. In such implementation, the control module 42 detects when misfire diagnostic processing is deactivated and, in response, activates the injectors 32.

As known in the art, a scan tool may be connected to control various devices in the vehicle 20, for example, during vehicle maintenance. It may be preferable to disable one or more aspects of the method 200 while maintenance is being performed. Accordingly, in the present implementation, in step 242 the control module 42 verifies whether a scan tool is being used. If the answer is yes in step 242, then control is transferred to step 280; otherwise control is transferred to step 246.

In step 246 the control module 42 disables at least one injector 32 associated by the control module 42 with the misfire. In step 252 the control module 42 verifies whether the proper cylinder(s) (i.e., the cylinder(s) in which misfire was detected) are disabled. If the proper cylinder(s) are disabled, control passes to step 256. If the proper cylinder(s) are not disabled, then control passes to step 280. In step 256 it is determined whether the misfire has switched from one or more cylinders to another one or more cylinders). If yes, then control passes to step 280. If the misfire has not switched, then control passes to step 260.

Generally, if the control module 42 is unable to diagnose misfire for various reasons, the control module 42 may disable the diagnosing of misfire. For example, misfire diagnosis may be disabled if input from the misfire sensing module 56 is not sufficiently reliable to allow the control module 42 to accurately diagnose misfire. If diagnosing of misfire is disabled over a pre-designated time period, then the injectors 32 are preferably enabled, so that full power might be available to the vehicle. Accordingly, in step 260 the control module 42 determines whether the diagnosing of misfire has been disabled for the pre-designated time period. If yes, then control is transferred to step 280; otherwise control passes to step 264. It should be noted that very short periods of disablement of misfire diagnostics (i.e., time periods shorter than the foregoing threshold) may not cause control to be transferred to step 280.

Generally, the control module 42 may make use of various diagnostic trouble codes (DTCs) maintained in the vehicle 20. Thus the control module 42 may take a particular action based on whether a particular DTC is active or inactive. Such DTCs could include, for example, a DTC indicating a short or open circuit for one of the injectors 32. Another such DTC may indicate a short or open ignition circuit for one of the cylinders 52. In step 264 the control module 42 checks whether one or more pre-designated DTCs are active or inactive. Such DTCs may previously have been determined by the control module 42 (e.g., in a previous iteration of various steps included in the method 200) to be active.

In step 268 it is determined whether a previously active DTC has become inactive. Such could be the case, for example, when a malfunction occurred but subsequently disappeared during engine operation. For example, an injector 32 disconnected during the course of engine maintenance could have caused activation of a DTC that subsequently is deactivated when the injector is re-connected. Other malfunctions could be indicated temporarily while the vehicle is being driven. If such a malfunction was detected and disappeared, control is transferred to step 280; if not, control passes to step 272. It should be noted that malfunction detection in various implementations of the present invention is not limited to the checking of DTCs, but can also involve the processing of sensor and other various inputs available to the control module 42. It also can be seen that in various instances, the control module 42 could perform an action based on a current setting of a DTC without having to check a previous status of such DTC.

In step 272 the control module 42 evaluates a user demand for engine power from the vehicle 20. For example, the control module 42 checks at least one of the throttle position sensor 50 and the accelerator pedal sensor 66 to determine whether the accelerator pedal 40 is in the process of being depressed to accelerate the vehicle engine speed. If the pedal 40 is transitioning to a high value, control passes to step 280. If the accelerator pedal 40 is not increasing, control passes to step 276.

In step 276 the control module 42 determines whether the pedal 40 has reached a predetermined high level (indicating, e.g., that the pedal 40 is pressed to its lowest position) and also checks whether more than one cylinder 52 are misfiring. If more than one cylinder are misfiring while the pedal 40 is at the high value, then control passes to step 280; otherwise control eventually returns to step 208.

In step 280 the control module 42 re-enables the disabled injector(s) 32, returns to closed-loop fuel control, and re-enables the canister purge valve 64. These same actions may also be performed periodically in step 288. In either case, from step 280 or step 288, control eventually is returned, for example, to step 208. In the present implementation, after one or more injectors 32 are disabled in step 246, the control module 42 periodically re-enables the injector(s) to test whether misfire is still present. Thus, for example, in step 288, previously disabled injector(s) are re-enabled. Control eventually returns to step 208.

Implementations of the foregoing method and system can be used to protect catalytic converters from misfire damage. By disabling fuel injectors on misfiring cylinders and initiating open-loop fuel control, the above described control system can prevent unburned fuel from causing an exothermic reaction in the catalytic converter. Excessive temperatures are prevented in the converter which might otherwise permanently damage the converter. Drivers and vehicle owners may thereby be relieved of what could be expensive repairs to or replacement of catalytic converters.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and the following claims.

What is claimed is:

1. A method of controlling engine operation in a vehicle in response to a misfire of one of a plurality of engine cylinders fueled through a plurality of fuel injectors, the vehicle further including a storage canister in which fuel vapor can be collected and from which the fuel vapor can be purged for delivery to the cylinders, said method comprising:

disabling at least one of the fuel injectors;

using an open loop to control fuel delivery by the injectors to the cylinders;

disabling purging of the canister, wherein said disabling and using steps are performed while the misfire continues;

evaluating a user demand for engine power from the vehicle, using at least one of a throttle position and a pedal position of the vehicle; and reversing said disabling and using steps based on said evaluating step.

2. The method of claim 1, further comprising:

verifying whether the at least one disabled fuel injector corresponds to the misfiring cylinder; and reversing said disabling and using steps based on said verifying step.

3. The method of claim 1, further comprising:

periodically re-enabling the at least one disabled injector;

testing whether misfire occurs in a cylinder associated with the at least one re-enabled injector; and reversing said disabling and using steps based on said testing step.

4. The method of claim 3, performed during engine operation.

5. The method of claim 1, wherein the vehicle further includes a misfire sensing module and a control module that provides a misfire diagnostic based on input from the misfire sensing module, said method further comprising:

determining whether the misfire is indicated by a reliable misfire diagnostic; and reversing said disabling and using steps based on said determining step.

6. The method of claim 5, wherein determining whether the misfire is indicated by a reliable misfire diagnostic comprises determining whether the control module has not provided a diagnostic for a predetermined period of time.

7. The method of claim 5, wherein determining whether the misfire is indicated by a reliable misfire diagnostic comprises determining whether the engine is operating in a particular operating region.

8. The method of claim 1, further comprising:

determining whether the misfire has switched to one or more other cylinders; and reversing said disabling and using steps based on said determining step.

9. The method of claim 1, further comprising:

testing whether a condition in the vehicle that prompted performance of said disabling and using steps has disappeared; and reversing said disabling and using steps based on said testing step.

10. The method of claim 1, further comprising:

checking a previously activated diagnostic trouble code (DTC); and reversing said disabling and using steps if the DTC is not activated.

11. A system for controlling engine operation in a vehicle in response to a misfire of one of a plurality of engine cylinders fueled through a plurality of fuel injectors, the vehicle further including an engine exhaust catalytic converter and a storage canister in which fuel vapor can be collected and from which the fuel vapor can be purged for delivery to the cylinders, said system comprising:

a misfire sensing module that senses the misfire; and a control module that provides a misfire diagnostic based on input from said misfire sensing module, and, based on the diagnostic and to prevent unburned fuel from entering the catalytic converter:

disables at least one of the fuel injectors;

uses an open loop to control fuel delivery by the injectors to the cylinders; and disables purging of the canister.

12. The system of claim 11, wherein said control module:

verifies whether the at least one disabled fuel injector corresponds to the misfiring cylinder; and based on the verifying:

re-enables the at least one disabled fuel injector;

uses a closed loop to control fuel delivery by the injectors to the cylinders; and re-enables purging of the canister.

13. The system of claim 11, wherein said control module:

periodically re-enables the at least one disabled injector;

tests whether misfire occurs in a cylinder associated with the at least one re-enabled injector; and based on the testing:

re-enables the at least one disabled fuel injector;

uses a closed loop to control fuel delivery by the injectors to the cylinders; and re-enables purging of the canister.

14. The system of claim 11, wherein said control module:

determines whether the misfire is indicated by a reliable diagnostic; and based on the determining:

re-enables the at least one disabled fuel injector;

uses a closed loop to control fuel delivery by the injectors to the cylinders; and re-enables purging of the canister.

15. The system of claim 14, wherein whether the misfire is indicated by a reliable diagnostic comprises whether said control module has not provided a diagnostic for a predetermined time period.

16. The system of claim 14, wherein said control module further determines whether the engine is operating within an operating region associated with reduced accuracy of misfire detection.

17. The system of claim 11, wherein said control module:

determines whether the misfire occurs in a cylinder different from a cylinder indicated by the misfire diagnostic; and based on the determining:

re-enables the at least one disabled fuel injector;

uses a closed loop to control fuel delivery by the injectors to the cylinders; and re-enables purging of the canister.

18. A method of controlling engine operation in a vehicle including a plurality of engine cylinders fueled through a plurality of fuel injectors, the vehicle further including a storage canister in which fuel vapor can be collected and which can be purged for delivery of the fuel vapor to the cylinders, said method comprising:

detecting a misfire of at least one of the cylinders;

analyzing at least one of the detected misfire and another misfire; and, based on said analyzing:

disabling at least one of the fuel injectors;

using an open loop to control fuel delivery by the injectors to the cylinders;

disabling purging of the canister;

determining whether the vehicle engine is operating in an operating region associated with inaccurate misfire detection; and reversing said disabling and using steps based on the determining.

19. The method of claim 18, wherein detecting a misfire comprises:

periodically re-enabling a disabled injector; and detecting a subsequent misfire in a cylinder associated with the re-enabled injector.

20. The method of claim 18, wherein analyzing further comprises determining whether a control module of the vehicle is providing an accurate misfire diagnostic.

21. The method of claim 18, wherein analyzing further comprises determining whether an engine condition relating to misfire was detected and disappeared.

22. The method of claim 18, wherein analyzing further comprises evaluating a user demand for engine power from the vehicle, said evaluating performed using at least one of a throttle position sensor and an accelerator pedal position sensor of the vehicle.

* * * * *